US012140158B2

(12) United States Patent
Pieri et al.

(10) Patent No.: US 12,140,158 B2
(45) Date of Patent: Nov. 12, 2024

(54) COOLING FAN MODULE

(71) Applicant: JOHNSON ELECTRIC ASTI S.R.L., Turin (IT)

(72) Inventors: Alexandre Pieri, Turin (IT); Renato Poncini, Asti (IT)

(73) Assignee: JOHNSON ELECTRIC ASTI S.R.L., Turin (IT)

( * ) Notice: Subject to any disclaimer, the term of this patent is extended or adjusted under 35 U.S.C. 154(b) by 0 days.

(21) Appl. No.: 18/427,097

(22) Filed: Jan. 30, 2024

(65) Prior Publication Data

US 2024/0167486 A1 May 23, 2024

Related U.S. Application Data

(63) Continuation of application No. PCT/CN2022/107467, filed on Jul. 22, 2022.

(30) Foreign Application Priority Data

Jul. 30, 2021 (IT) ..... 102021000020606

(51) Int. Cl.
*F04D 29/52* (2006.01)
*F04D 19/00* (2006.01)
*F04D 29/32* (2006.01)

(52) U.S. Cl.
CPC ..... *F04D 29/522* (2013.01); *F04D 19/002* (2013.01); *F04D 29/326* (2013.01); *F04D 29/526* (2013.01)

(58) Field of Classification Search
CPC ..... F04D 29/326; F04D 29/526; F04D 19/002
See application file for complete search history.

(56) References Cited

U.S. PATENT DOCUMENTS 5,489,186 A * 2/1996 Yapp ..... F01D 5/141 415/58.7
7,114,921 B2 * 10/2006 Iwasaki ..... F04D 29/326 416/189

(Continued)

FOREIGN PATENT DOCUMENTS

CN 1441170 A 9/2003
CN 2750559 Y 1/2006

(Continued)

OTHER PUBLICATIONS

International Search Report from corresponding PCT Application No. PCT/CN2022/107467 Nov. 1, 2022.

*Primary Examiner* — Justin D Seabe
(74) *Attorney, Agent, or Firm* — Aird & McBurney LP

(57) ABSTRACT

A cooling fan module (10) for a vehicle is provided, including a frame (12) and a fan (18). The frame (12) includes an edge (16) which defines an opening (14) of a substantially circular shape through the frame (12) which allows the passage of a flow of air along the direction of an axis central (z) of the opening (14). The fan (18) includes a plurality of blades (20), the fan (18) being arranged to rotate around the central axis (z) to convey the flow of air through the opening (14). The edge (16) includes at least a first cylindrical wall (22) and a second cylindrical wall (24) coaxial with the central axis (z) of the opening (14). The second cylindrical wall (24) protrudes beyond the first cylindrical wall (22) in the direction of the central axis (z). The first cylindrical wall (22) is arranged at a first radial distance from the central axis (z), and the second cylindrical wall (24) is arranged at a second radial distance from the central axis (z), greater than the first radial distance.

19 Claims, 9 Drawing Sheets

(56) References Cited

U.S. PATENT DOCUMENTS

| | | | | |
|---|---|---|---|---|
| 7,762,769 | B2 * | 7/2010 | Stevens | F04D 29/326<br>416/189 |
| 9,714,666 | B2 * | 7/2017 | Schafer | F04D 29/326 |
| 10,605,256 | B2 * | 3/2020 | Tyner | F04D 29/326 |
| 10,844,770 | B2 * | 11/2020 | Hong | F01P 11/10 |
| 11,142,038 | B2 * | 10/2021 | Stauter | B60H 1/00464 |
| 2022/0316496 | A1 * | 10/2022 | Froh | F04D 29/526 |

FOREIGN PATENT DOCUMENTS

| | | | |
|---|---|---|---|
| CN | 1813135 | A | 8/2006 |
| CN | 103649487 | A | 3/2014 |
| CN | 211422754 | U | 9/2020 |
| KR | 20110136165 | A | 12/2011 |

* cited by examiner

COOLING FAN MODULE

CROSS REFERENCE TO RELATED APPLICATIONS

This non-provisional patent application is a continuation application of PCT Application No. PCT/CN2022/107467, filed on Jul. 22, 2022, which claims priority to Italian Patent Application No. 102021000020606, filed on Jul. 30, 2021, all of which are incorporated herein by reference in their entireties.

TECHNICAL FIELD

The present disclosure relates to the technical field of axial fan modules for vehicles, and more particularly to a fan module for cooling a heat exchange component of a vehicle, such as a radiator of an air conditioning system of the vehicle or of an engine of the vehicle.

BACKGROUND

Existing motor vehicles typically have a fan module installed for cooling components that are subject to heat. These fan modules generally have an opening in which a fan having a plurality of blades is arranged, in a known manner, to facilitate air circulation and cool the heat exchange component.

Generally, however, known fan modules have aerodynamic and aeroacoustic problems that cause annoying sound emission. In fact, generally the difference in pressure between two axial sides of each blade of the fan in an axial direction, i.e. between the intrados side 1 (shown in FIG. 2) with higher pressure and the extrados side 2 (shown in FIG. 2) with lower pressure, extends along the entire blade, from the root to the apex. Consequently, the topology of the air flow induced by the known fans includes a helical recirculation flow at the apex of each fan blade. The helical recirculation flow has a negative impact on the performance of the fan both in terms of air flow and aero-acoustics, and consequently in terms of sound emission resulting in both an increase in weighted overall noise and a worsening of harmonics (tonal noise).

SUMMARY

It is the object of the present disclosure to provide a fan module which does not have the disadvantages of the known art, especially a fan module which is less noisy.

According to the present disclosure, a cooling fan module for a vehicle is provided. The cooling fan module includes a frame and a fan. The frame includes an edge which defines an opening of substantially circular shape through the frame, the opening allowing a passage of air flow along a direction of a central axis of the opening. The fan includes a plurality of blades. The fan is arranged to rotate about the central axis to convey air flow through the opening. The edge includes at least a first cylindrical wall and a second cylindrical wall that are coaxial with the central axis of the opening. The second cylindrical wall protrudes beyond the first cylindrical wall in the direction of the central axis. The first cylindrical wall is arranged at a first radial distance from the central axis, and the second cylindrical wall is arranged at a second radial distance from the central axis. The second radial distance is greater than the first radial distance.

Preferably, the first cylindrical wall and the second cylindrical wall are partially overlapped in the direction of the central axis.

Preferably, the edge further includes an annular wall, wherein the first cylindrical wall and the second cylindrical wall are arranged on the annular wall and extend in the direction of the central axis.

Preferably, the annular wall substantially has the shape of a truncated cone, and extends inclined relative to the central axis, and wherein a first annular groove is formed between the first cylindrical wall and the annular wall.

Preferably, the edge further includes a plurality of first ribs that are arranged at intervals in a circumferential direction and located between the first cylindrical wall and second cylindrical wall in a radial direction relative to the central axis, for reducing or limiting a tangential component of a helical recirculation flow.

Preferably, a radial inner side of the first rib is connected to the first cylindrical wall and a radial outer side of the first rib is connected to the annular wall or the second cylindrical wall.

Preferably, the fan further includes an outer ring, radially outer ends of the blades are connected by the outer ring, the edge further includes a flange that extends in a radially internal direction from the first cylindrical wall or the annular wall, and is spaced from the outer ring in the direction of the central axis, the edge further includes a plurality of second ribs for further reducing or limiting the tangential component of the helical recirculation flow, which are arranged at intervals on the flange in the circumferential direction.

Preferably, the first ribs and the second ribs extend substantially in a radial direction relative to the central axis.

Preferably, the second ribs are radially aligned with the first ribs.

Preferably, the second ribs and the first ribs are located at different positions in the direction of the central axis.

Preferably, an annular groove is arranged radially outside the second cylindrical wall and adjacent to the second cylindrical wall, and wherein a plurality of third ribs extend substantially in a radial direction relative to the central axis and are arranged in the annular groove, for further reducing or limiting the tangential component of the helical recirculation flow.

Preferably, the outer ring of the fan includes a cylindrical wall coaxial with the central axis, the flange has a third cylindrical wall coaxial with the central axis, the third cylindrical wall and the cylindrical wall of the outer ring have substantially the same radial distance relative to the central axis.

Preferably, a distance between the cylindrical wall of the outer ring and the third cylindrical wall in the direction of the central axis is greater than or equal to 4 mm and smaller than or equal to 6 mm.

Preferably, at least one of the frame and the fan is made of a material including polypropylene reinforced with glass fiber or polyamide reinforced with glass fiber.

DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE EMBODIMENTS

Figure 1:
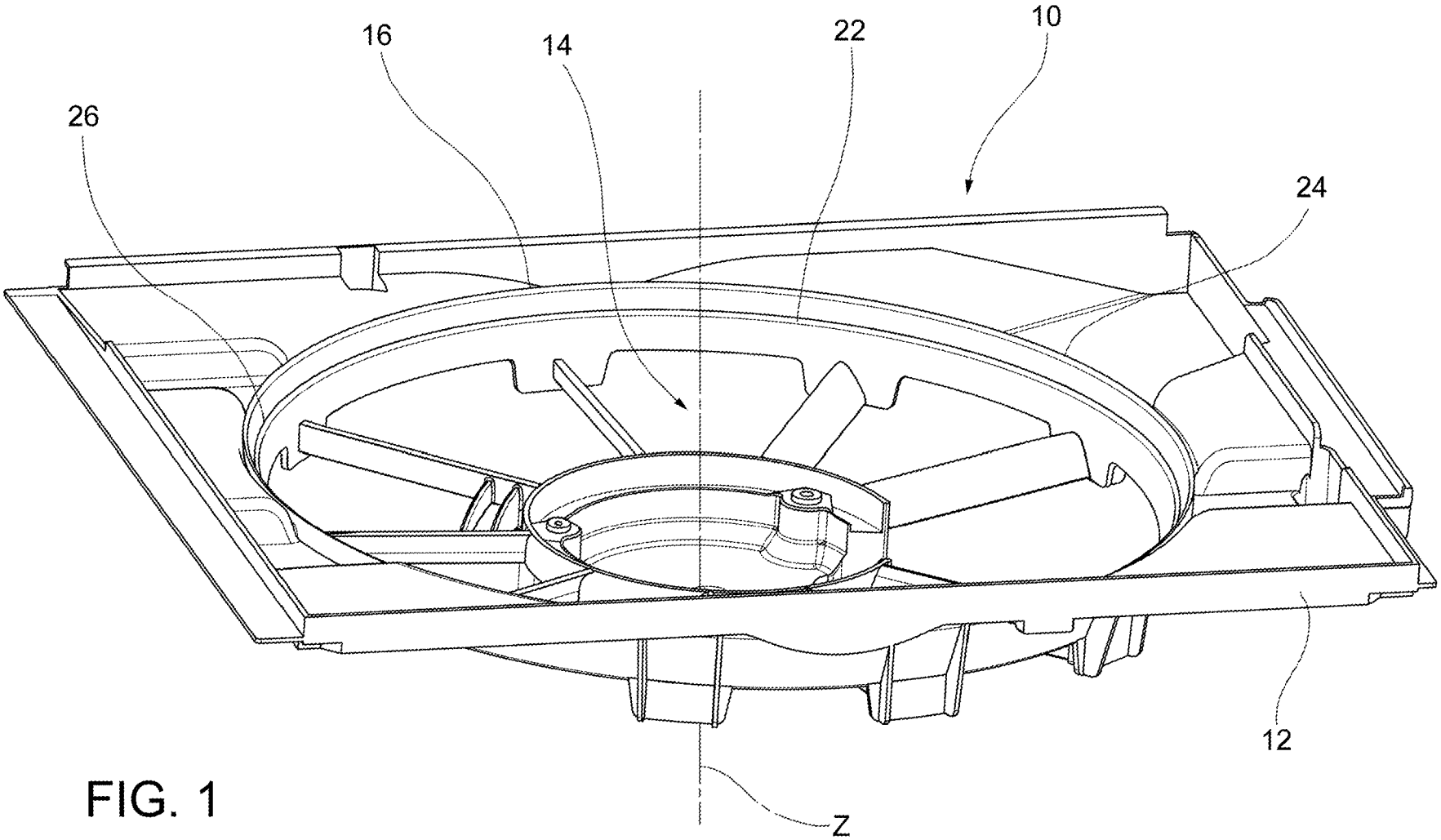
FIG. 1 is a perspective view of a fan module according to an embodiment of the present disclosure, in which the fan is removed for clarity.

The subject matter will be described in conjunction with the accompanying drawings and the preferred embodiments. The described embodiments are only a few and not all of the embodiments of the present disclosure. All other embodiments obtained by those ordinarily skilled in the art based on the embodiments of the present disclosure without any creative efforts fall within the protection scope of the present disclosure. It is to be understood that the drawings are provided for reference only and are not intended to be limiting of the invention. The dimensions shown in the drawings are only for convenience of illustration and are not intended to be limiting. In general, in the present description and in the attached claims, terms such as 'tangential', 'meridian', 'internal', 'radial', 'radially', 'transverse', 'transversely', 'axial' and the like, are used with the usual meaning in the relevant technical field.

With reference to the FIGS. 1 to 5, in general, the fan module according to the present disclosure is indicated with the reference number 10. The fan module 10 essentially includes a frame 12 and a fan 18.

The frame 12, or conveyor, is made as a support and covering element, to protect the fan 18. In particular, the frame 12 generally has a first side 12*a* and a second side 12*b*, opposite to the first side 12*a*, and an opening 14, substantially circular in shape. The opening 14 is defined coaxially around a central axis z and extends through the frame 12 to allow a passage of air flow between the first side 12*a* and the second side 12*b* along a direction of the central axis z.

Figure 1A:
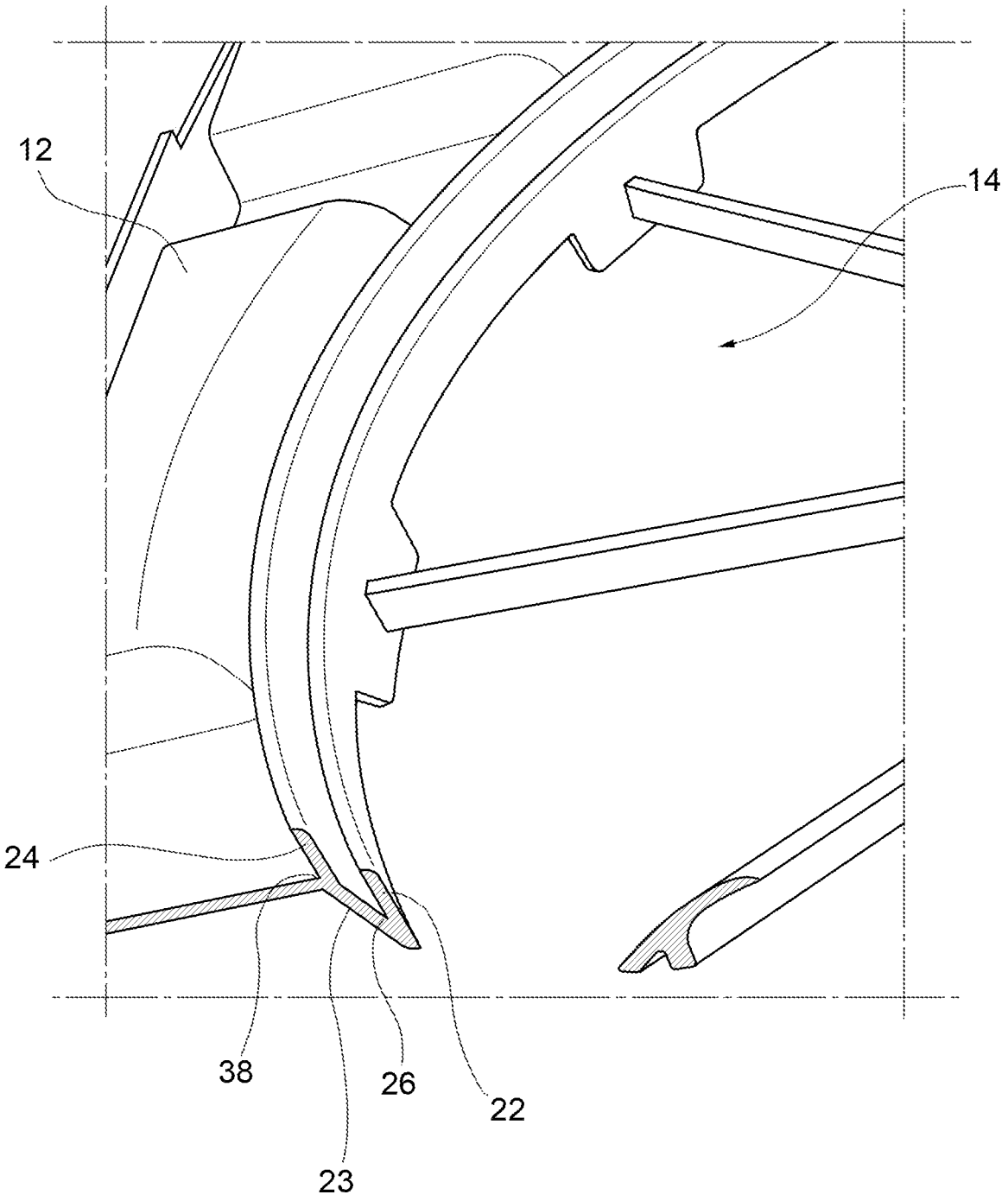
FIG. 1*a* is a perspective detail view in partial section of the fan module of FIG. 1.
Figure 1B:
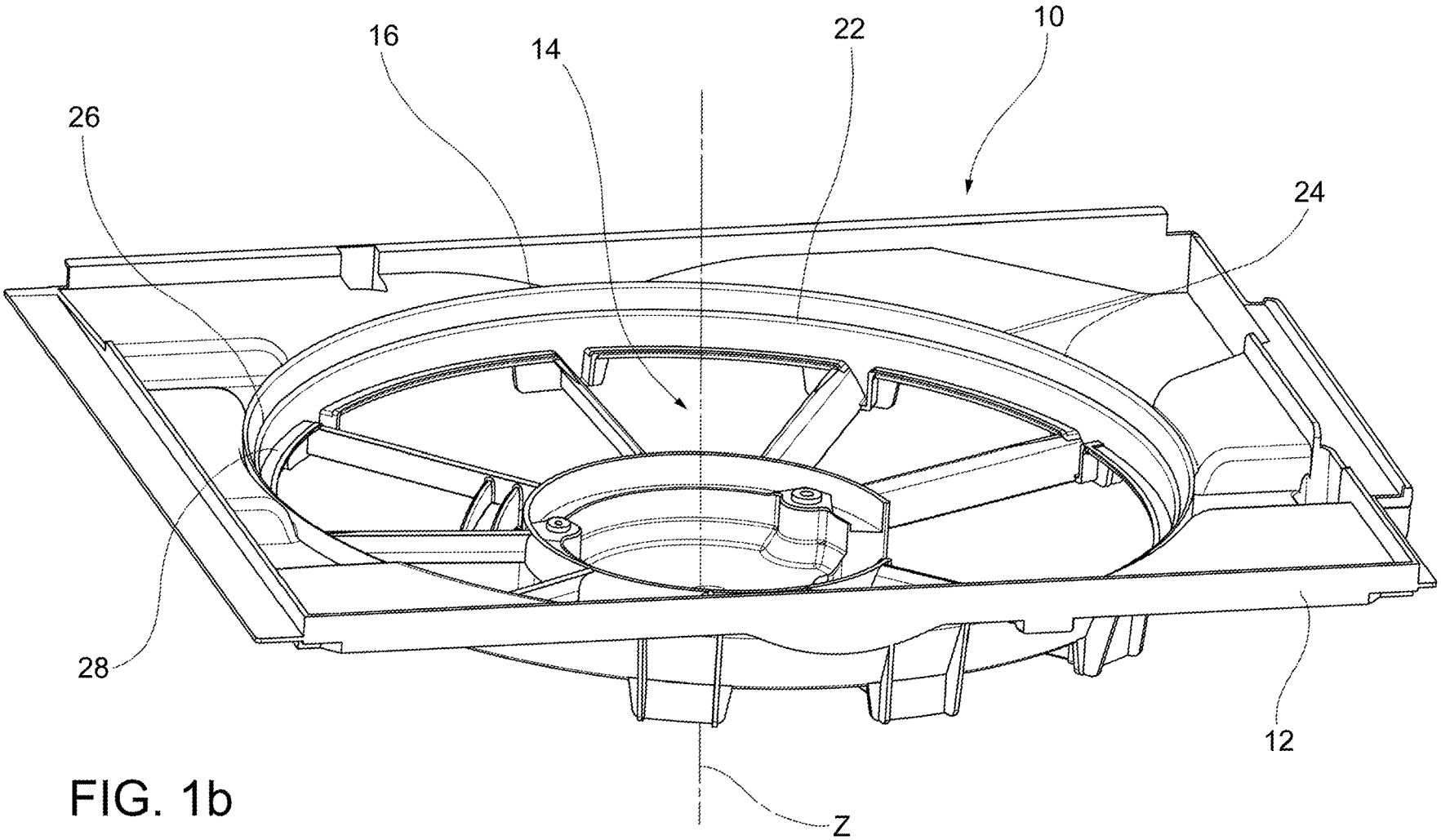
FIG. 1B is a perspective view of a fan module according to another embodiment of the present disclosure, in which the fan is removed for clarity.
Figure 1C:
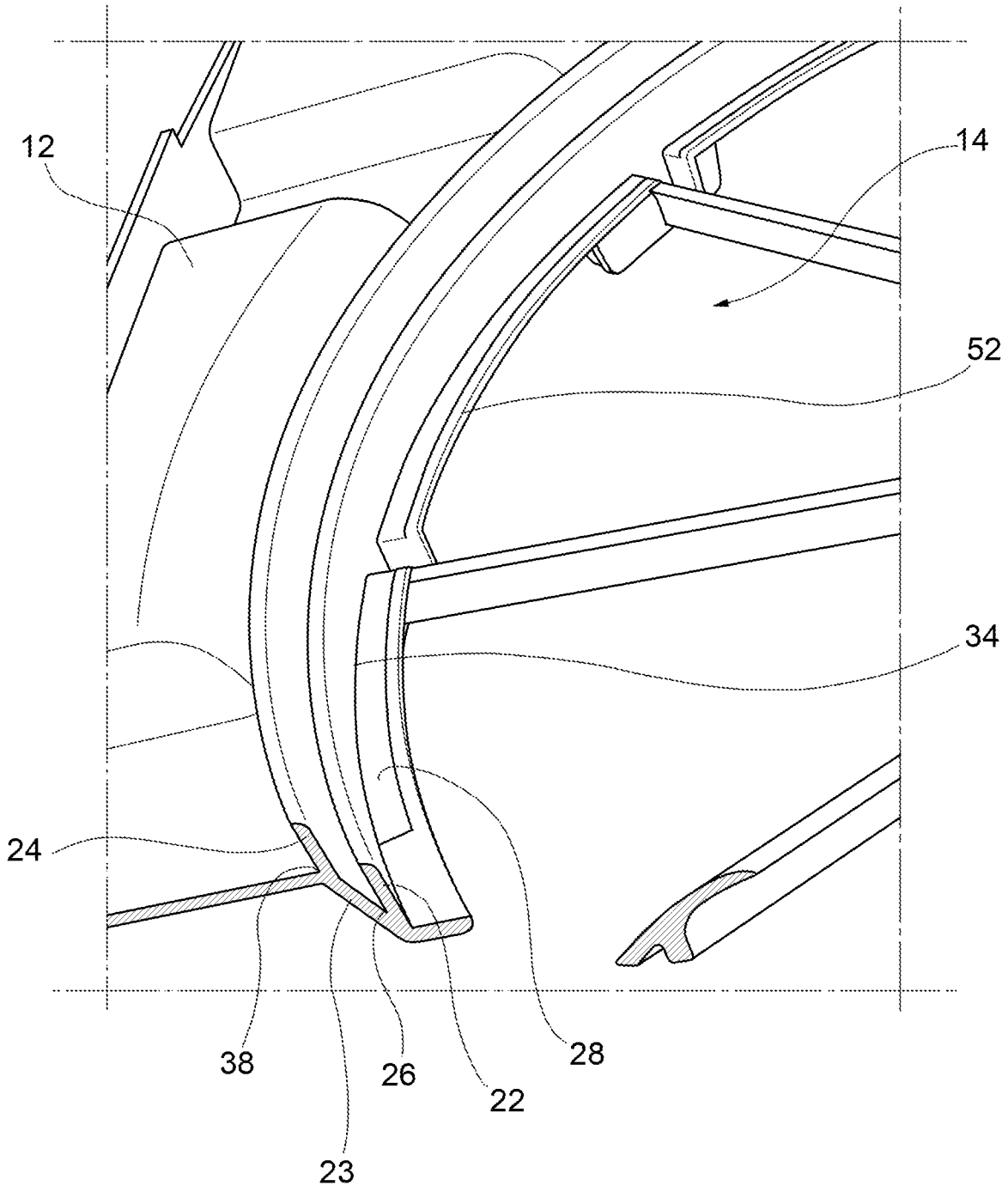
FIG. 1*c* is a perspective detail view in partial section of the fan module of FIG. 1*b;*

With particular reference to FIGS. 1 and 1*a*, the opening 14 is delimited by an edge 16, clearly also of a substantially circular or annular shape. The edge 16 includes a first cylindrical wall 22 and a second cylindrical wall 24, which are coaxial with the central axis z of the opening 14. The first cylindrical wall 22 and the second cylindrical wall 24 preferably extend along the direction of the central axis z. The first and second cylindrical walls 22, 24 have a substantially cylindrical shape, such as a sleeve, or similar to the side wall of a cylinder with a substantially circular base. The second cylindrical wall 24 protrudes beyond the first cylindrical wall 22 in the direction of the central axis z.

An axis of a cylinder that defines the first cylindrical wall 22 and an axis of a cylinder that defines the second cylindrical wall 24 coincide with the central axis z. Furthermore, the first cylindrical wall 22 is arranged at a first radial distance from the central axis z, while the second cylindrical wall 24 is arranged at a second radial distance from the central axis z. The second radial distance is greater than the first radial distance. In the context of this description and the attached claims, a 'radial' direction refers, in a manner which is self-evident to those skilled in the art, to a direction passing through the central axis z and lying on a plane perpendicular to the central axis z. Preferably, the first cylindrical wall 22 and the second cylindrical wall 24 are partially overlapped in the direction of the central axis z.

The fan 18 includes a plurality of blades 20 spaced around a central hub in a known manner. For example, the plurality of blades 20 may be angularly equally spaced around the central hub. The fan 18 is rotatably mounted and supported by the frame 12, so as to rotate around the central axis z and convey air flow through the opening 14 along the direction of the central axis z. Essentially, therefore, the fan 18 functions as an axial fan.

Figure 2:
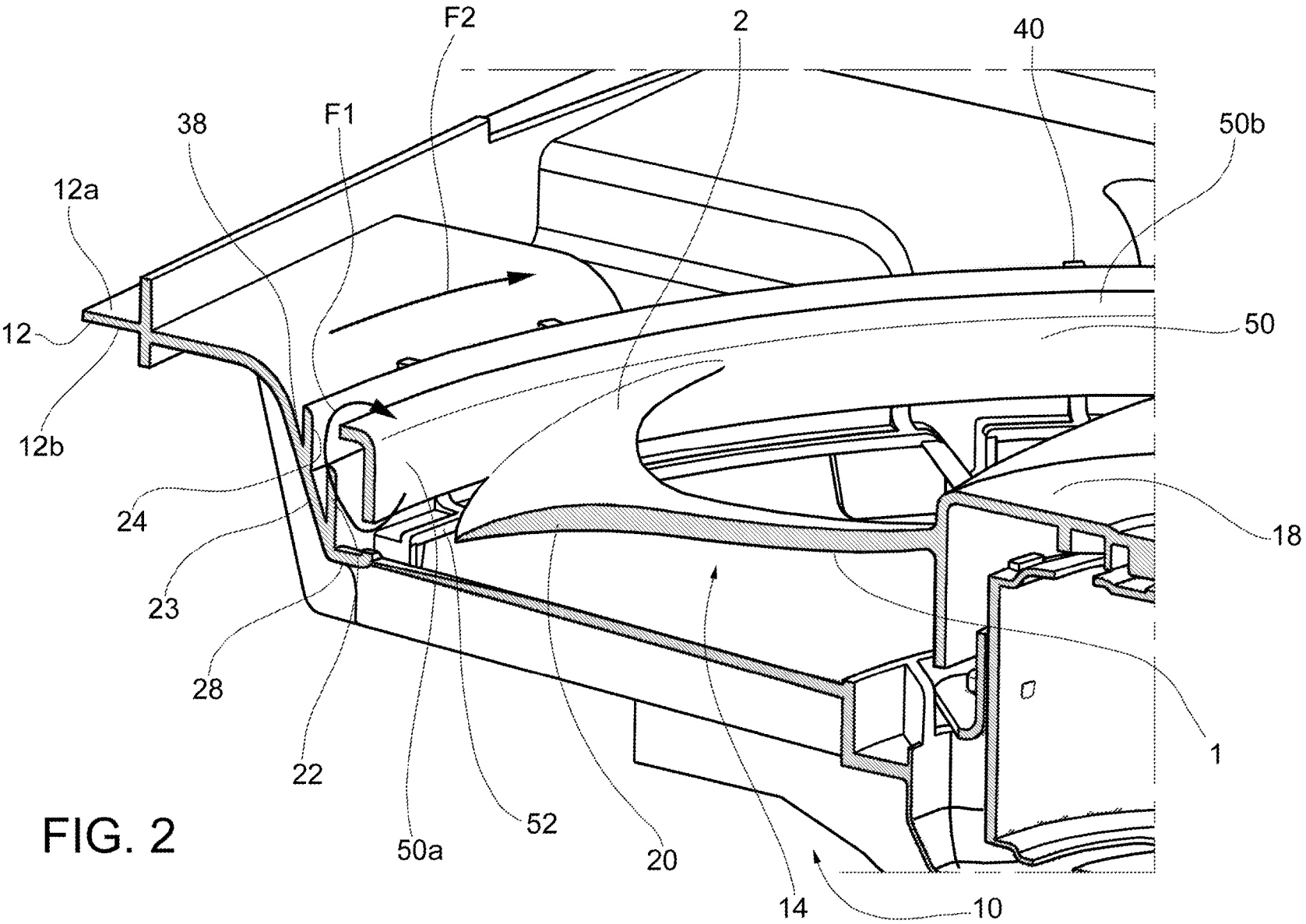
FIG. 2 is a perspective detail view in partial section of the fan module of FIG. 1*d;*
Figure 3:
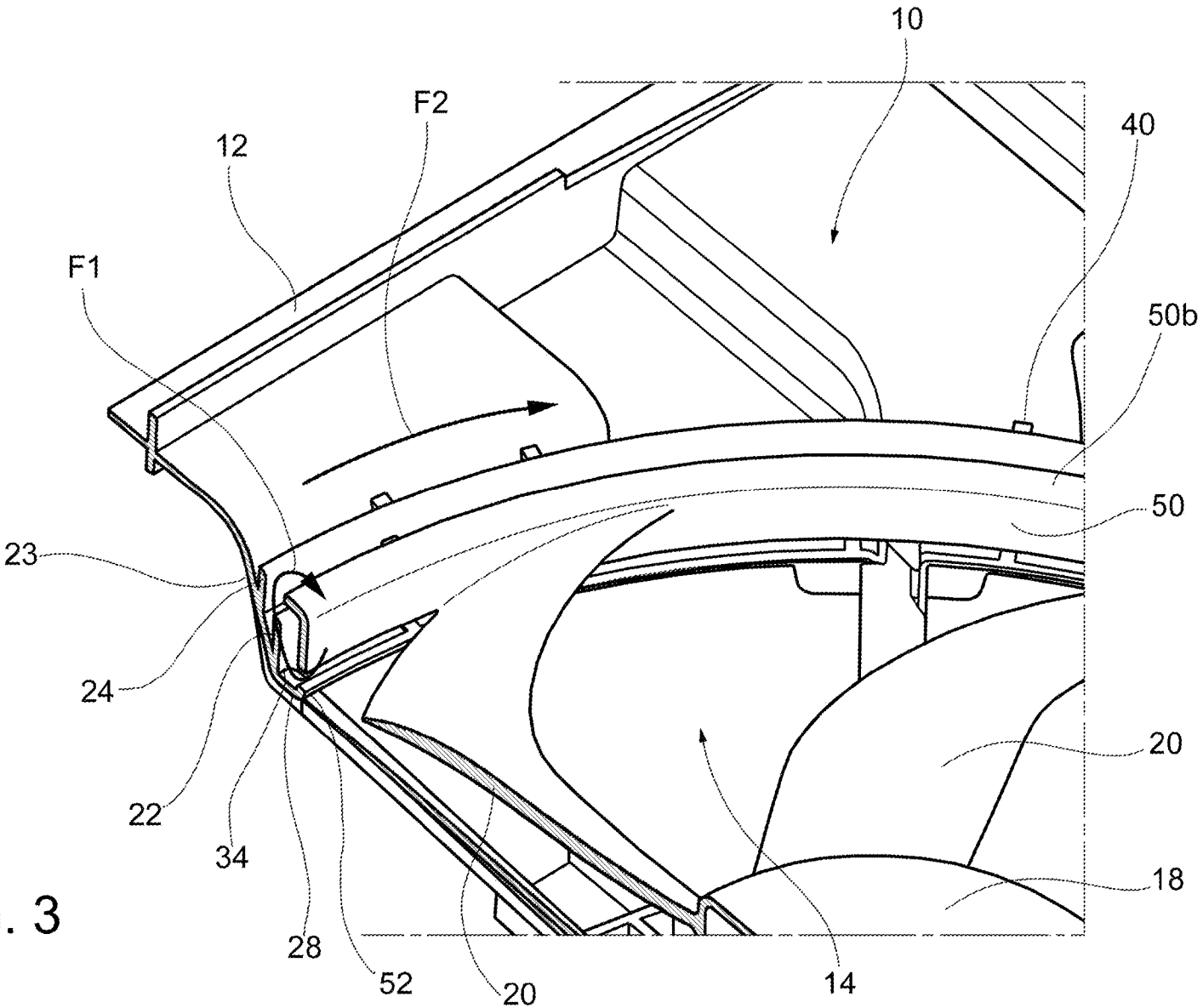
FIG. 3 is a view similar to that of FIG. 2, but from a different angle.

In an advantageous embodiment, the fan 18 includes an outer ring 50. Preferably, this outer ring 50 has an L-shaped cross section, as seen in FIGS. 2 and 3. The blades 20 of the fan 18 are interconnected with each other through the outer ring 50, at respective radially outer ends of the blades 20. In particular, the outer ring 50 includes a first wall 50*a* and a second wall 50*b* that form an L-shape together. Preferably, the first wall 50*a* of the outer ring 50 is a cylindrical wall which is coaxial to the central axis z. Preferably, the first wall 50*a* of the outer ring 50 is arranged at a radially inner position with respect to the first cylindrical wall 22. Basically, the outer ring 50 acts as a structural support for the portion of radially outer ends of the blades 20.

Preferably, at least one of the frame 12 and the fan 18 is made of a material including polypropylene reinforced with glass fiber, in particular PP-GF20, PP-GF30 or PP-GF35, or polyamide reinforced with glass fiber, in particular PA6-GF30 or PA66-GF25.

The edge 16 of the opening 14 also preferably includes an annular wall 23. The first cylindrical wall 22 and the second cylindrical wall 24 are arranged spaced apart on the annular wall 23 and extend in the direction of the central axis z. Preferably, the annular wall 23 has the shape of a truncated cone, and therefore extends in a direction angled or inclined with respect to the central axis z. Even more preferably, a first annular groove 26 is formed between the first cylindrical wall 22 and the annular wall 23.

The annular wall 23 is connected to the frame 12, preferably by means of a circular fitting having a fitting radius suitable for facilitating the air flow.

Preferably, with reference to FIGS. 1*b*, 1*c*, 2 and 3, the edge 16 of the opening 14 further includes a flange 28 which extends in a radially inward direction starting from the first cylindrical wall 22 or the annular wall 23. Preferably, the flange 28 extends on a plane transversal to the central axis z. Preferably, the flange 28 extends radially from a first end 34 of the first cylindrical wall 22 or an end of the annular wall 23 towards the inside of the opening 14. Preferably, the flange 28 has a third cylindrical wall 52 which is coaxial with the central axis z and preferably extends along the direction of the central axis z, concentric with the first cylindrical wall 22 and the second cylindrical wall 24. Preferably, the height of the third cylindrical wall 52 is significantly smaller than the height of the first cylindrical wall 22 or the height of the second cylindrical wall 24.

Advantageously, when the third cylindrical wall 52 is also present, it is preferably arranged to be aligned with the first wall 50*a* of the outer ring 50 of the fan 18, so that the third cylindrical wall 52 and the cylindrical wall 50*a* of the outer ring 50 of the fan 18 have substantially the same radial distance relative to the central axis z. Even more advantageously, in this embodiment, the distance between the first wall 50*a* of the outer ring 50 of the fan 18 and the third cylindrical wall 52 in the direction of the central axis z is preferably between about 4 mm and about 6 mm, and more preferably is about 5 mm. In this way, it is possible to further limit the recirculation of the air flow and the resulting noise.

Figure 1D:
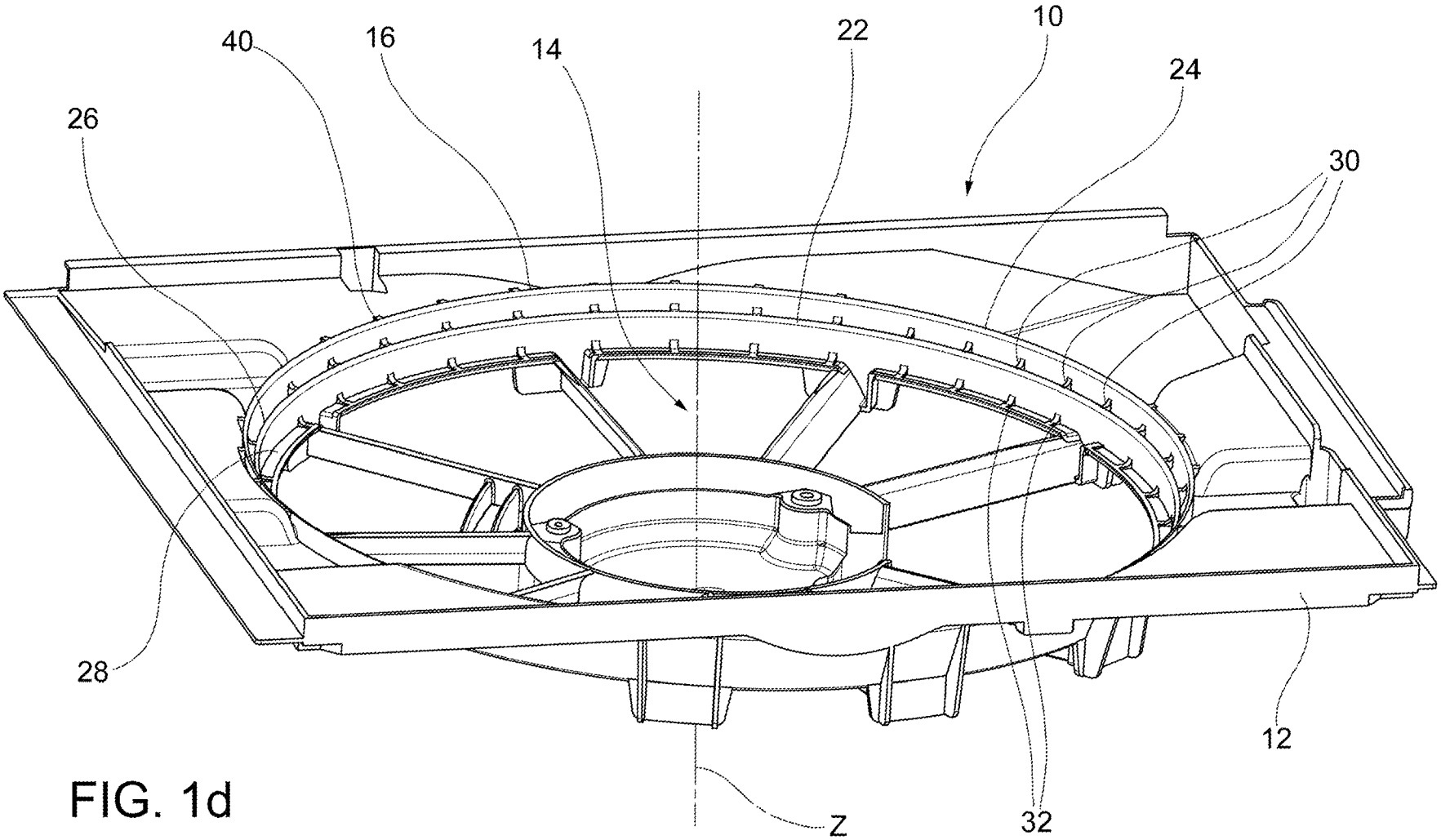
FIG. 1*d* is a perspective view of a fan module according to still another embodiment of the present disclosure, in which the fan is removed for clarity.

With particular reference to FIG. 1*d*, in a preferred embodiment, the fan module 10 further includes a plurality of first ribs 30. The first ribs 30 can be arranged between the annular wall 23 and the first cylindrical wall 22. The first ribs 30 preferably extend in the radial direction with respect to the central axis z. Preferably, the first ribs 30 are connected to the first cylindrical wall 22 and the annular wall 23. Preferably, the first ribs 30 are connected to the second cylindrical wall 24. Preferably, the first ribs 30 are angularly spaced along a circumferential direction. In an embodiment, the first ribs 30 can be equally spaced in the circumferential direction. In an alternative embodiment, the first ribs 30 can be arranged asymmetrically, that is, an angular distance between two successive first ribs 30 are not constant.

In a further preferred embodiment, the fan module 10 further includes a plurality of second ribs 32. The second ribs 32 are arranged for example on the flange 28. The second ribs 32 preferably extend in the radial direction with respect to the central axis z, starting from the first cylindrical wall 22. Preferably, the second ribs 32 are arranged radially aligned with the first ribs 30. Preferably, the second ribs 32 are angularly spaced along the circumferential direction. Preferably, the second ribs 32 are joined with the first circular wall 22. In an embodiment, the second ribs 32 can be equally spaced in the circumferential direction. In an alternative embodiment, the second ribs 32 can be arranged asymmetrically, that is, an angular distance between two successive second ribs 32 is not constant.

In a further preferred embodiment, the fan module 10 further has a second annular groove 38, which is arranged radially outside the second cylindrical wall 24 and adjacent to the second cylindrical wall 24. Preferably, the second annular groove 38 is formed between the annular wall 23 and the second cylindrical wall 24.

In the second annular groove 38, a plurality of third ribs 40 can be arranged. The third ribs 40 preferably extend in the radial direction with respect to the central axis z. Preferably, the third ribs 40 are arranged radially aligned with the first ribs 30 and the second ribs 32. Preferably, one side of the third ribs 40 is joined with the second cylindrical wall 24, and the other side of the third ribs 40 is joined with the annular wall 23.

The third ribs 40 are angularly spaced along the circumferential direction. In an embodiment, the third ribs 40 can be equally spaced in the circumferential direction. In an alternative embodiment, the third ribs 40 can be arranged asymmetrically, that is, an angular distance between two successive third ribs 40 is not constant.

Figure 4:
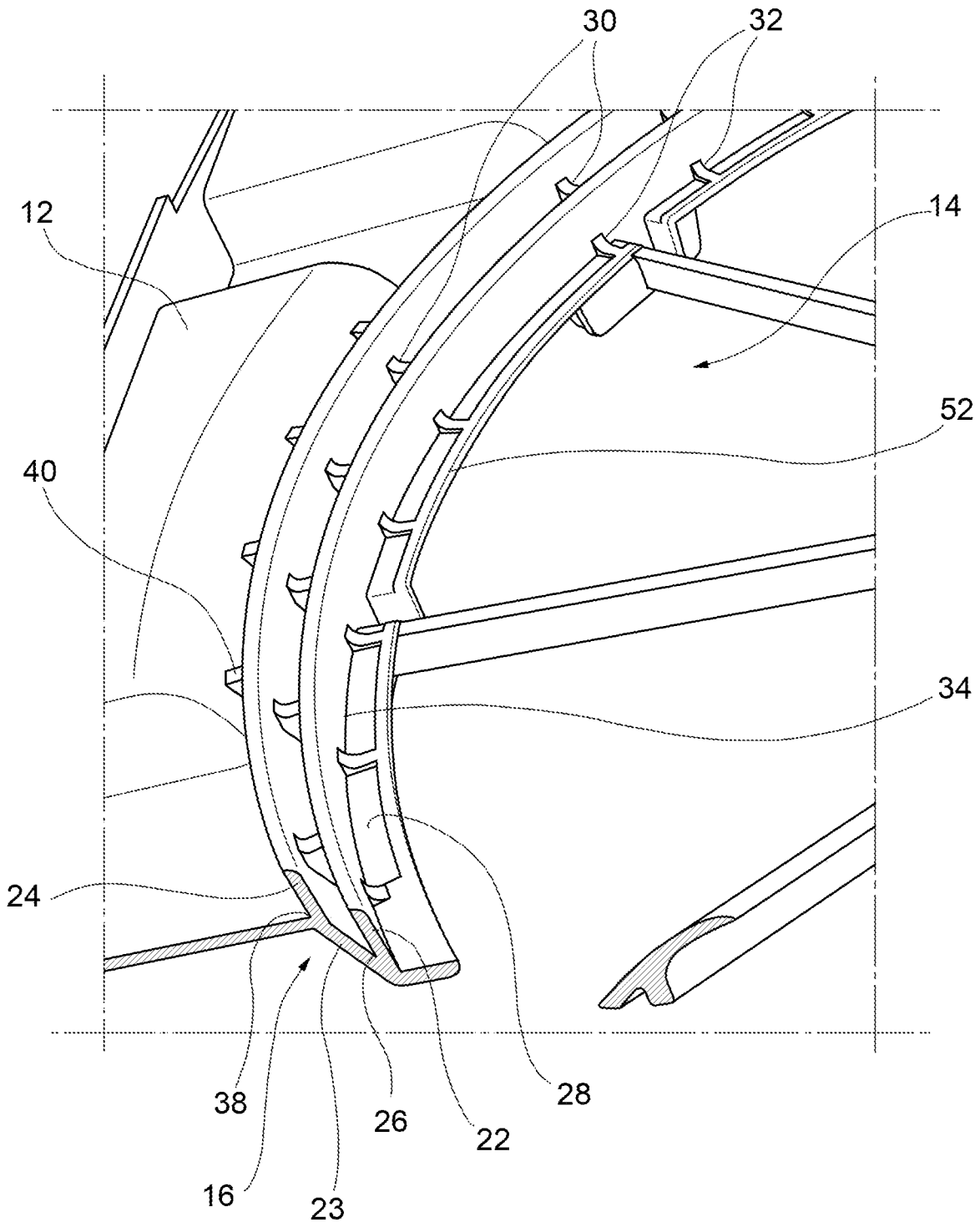
FIG. 4 is a further view of the fan module of FIG. 2, in which the fan is removed for clarity.

The first ribs 30, the second ribs 32 and the third ribs 40 are visible in FIG. 1*d*, and more clearly in FIG. 4.

Figure 5:
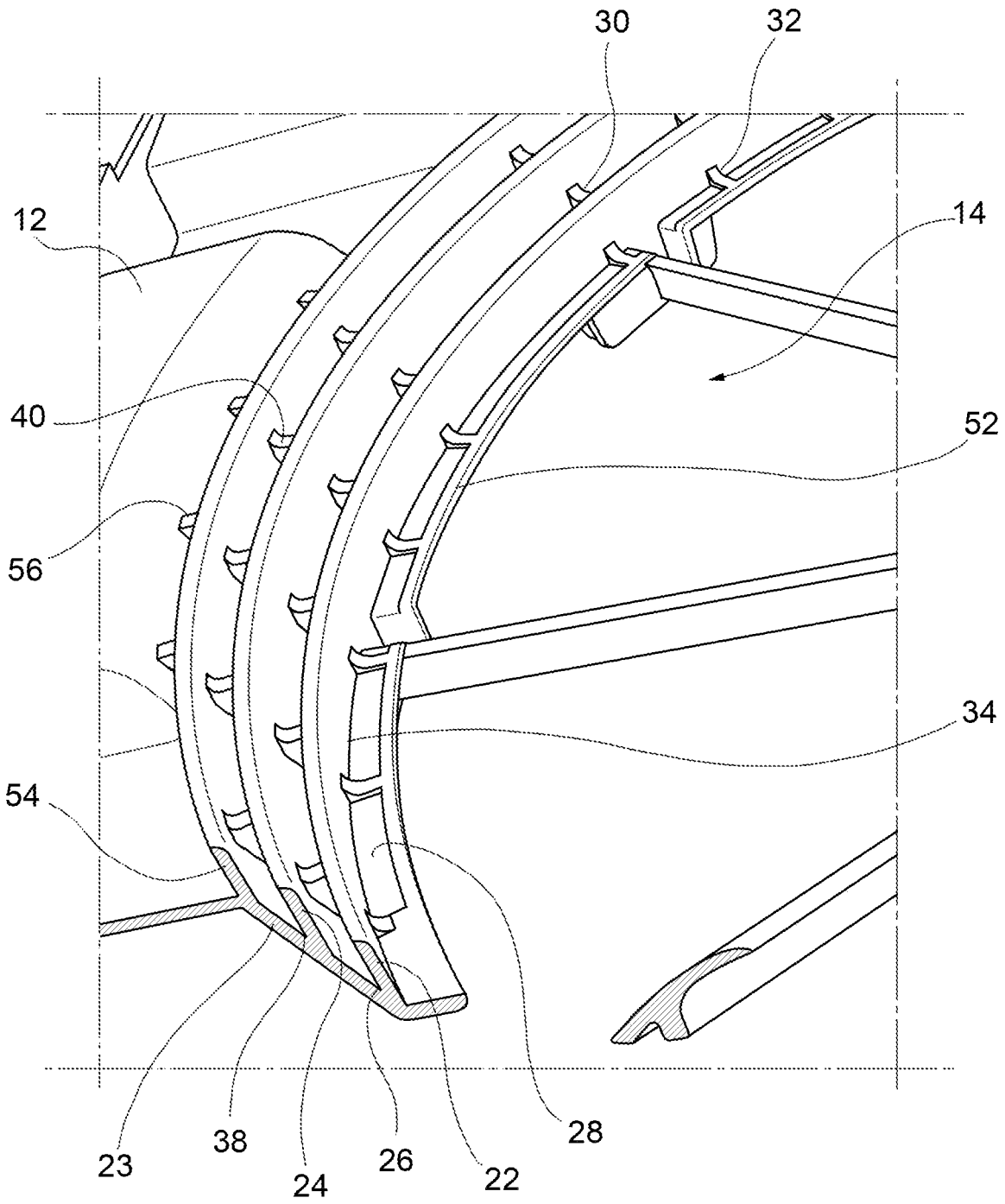
FIG. 5 is a view similar to FIG. 4, of a further embodiment which further includes a fourth cylindrical wall.

It can be understood that the fan module 10 can further include more cylindrical walls arranged in a similar way to the first cylindrical wall 22 and the second cylindrical wall 24 without thereby departing from the scope of the present disclosure. For example, as can be seen in FIG. 5, the fan module 10 according to a further embodiment includes a fourth cylindrical wall 54, having characteristics similar to the first cylindrical wall 22 and the second cylindrical wall 24. The fourth cylindrical wall 54 is arranged radially outside the second cylindrical wall 24, coaxial with the central axis z and therefore coaxial with the first cylindrical wall 22 and the second cylindrical wall 24. Similar to what has been described with respect to the second cylindrical wall 24 and the third ribs 40, a plurality of fourth ribs 56 can be arranged radially outside the fourth cylindrical wall 54 and starting from the fourth cylindrical wall 54. The fourth ribs 56 have characteristics similar to the first ribs 30, the second ribs 32 and the third ribs 40.

The present disclosure provides an improved fan module with respect to the known art. In the present disclosure, the helical recirculation flow caused by the blades 20 of the fan 18 can be divided into two components: a tangential component and a meridian component.

First of all, thanks to the relative arrangement of the first cylindrical wall 22 and the second cylindrical wall 24, the edge 16 of the cylindrical opening 14 is able to reduce or limit the meridian component of the helical recirculation flow. The meridian component of the recirculation flow substantially flows around the outer ring 50 of the fan 18. The flow direction of the meridian component is shown with the arrow F1 in FIGS. 2 and 3. The cylindrical walls arranged coaxially with respect to the axis central z can inhibit the meridian component of the recirculation flow.

Furthermore, thanks to the arrangement of the first ribs 30, the second ribs 32, and/or the third ribs 40, the edge 16 of the cylindrical opening 14 is able to reduce or limit the tangential component of the helical recirculation flow. This tangential component of the recirculation flow substantially flows along an outer circumference of the outer ring 50 of the fan 18. The flow direction of the tangential component is shown with the arrow F2 in FIGS. 2 and 3. The ribs arranged between the cylindrical walls can inhibit the tangential component of the recirculation flow.

In any case, it should be understood that both structural characteristics suitable for inhibiting the aerodynamic flow (i.e. both the cylindrical walls and the ribs) act on both components of the flow (tangential component and meridian component) even when considered isolated, and that, therefore, they collaborate synergistically to further reduce noise.

Although certain inventive embodiments of the present disclosure have been specifically described, the present disclosure is not to be construed as being limited thereto. Various changes or modifications may be made to the present disclosure without departing from the scope of the present disclosure.

The invention claimed is:

1. A cooling fan module (10) for a vehicle, comprising:

a frame (12), comprising an edge (16) which defines an opening (14) of substantially circular shape through the frame (12), the opening (14) allowing a passage of air flow along a direction of a central axis (z) of the opening (14); and a fan (18) comprising a plurality of blades (20), the fan (18) being arranged to rotate about the central axis (z) to convey air flow through the opening (14);

wherein, the edge (16) comprises at least a first cylindrical wall (22) and a second cylindrical wall (24) that are coaxial with the central axis (z) of the opening (14), the second cylindrical wall (24) protrudes beyond the first cylindrical wall (22) in the direction of the central axis (z), the first cylindrical wall (22) is arranged at a first radial distance from the central axis (z), and the second cylindrical wall (24) is arranged at a second radial distance from the central axis (z), the second radial distance being greater than the first radial distance, the edge (16) further comprises an annular wall (23), wherein the first cylindrical wall (22) and the second cylindrical wall (24) are arranged on the annular wall (23) and extend in the direction of the central axis (z), the edge (16) further comprises a plurality of first ribs (30) that are arranged at intervals in a circumferential direction and located between the first cylindrical wall (22) and second cylindrical wall (24) in a radial direction relative to the central axis (z), for reducing or limiting a tangential component of a helical recirculation flow, a radial inner side of the first rib (30) is connected to the first cylindrical wall (22) and a radial outer side of the first rib (30) is connected to the annular wall (23) or the second cylindrical wall (24).

2. The cooling fan module according to claim 1, wherein, the first cylindrical wall (22) and the second cylindrical wall (24) are partially overlapped in the direction of the central axis (z).

3. The cooling fan module according to claim 1, wherein, the annular wall (23) substantially has the shape of a truncated cone, and extends inclined relative to the central axis (z), and wherein a first annular groove (26) is formed between the first cylindrical wall (22) and the annular wall (23).

4. The cooling fan module according to claim 1, wherein, the fan (18) further comprises an outer ring (50), radially outer ends of the blades (20) are connected by the outer ring (50), the edge (16) further comprises a flange (28) that extends in a radially internal direction from the first cylindrical wall (22) or the annular wall (23), and is spaced from the outer ring (50) in the direction of the central axis (z), the edge (16) further comprises a plurality of second ribs (32) for further reducing or limiting the tangential component of the helical recirculation flow, which are arranged at intervals on the flange (28) in the circumferential direction.

5. The cooling fan module according to claim 4, wherein, the first ribs (30) and the second ribs (32) extend substantially in the radial direction relative to the central axis (z).

6. The cooling fan module according to claim 4, wherein, the second ribs (32) are radially aligned with the first ribs (30).

7. The cooling fan module according to claim 4, wherein, the second ribs (32) and the first ribs (30) are located at different positions in the direction of the central axis (z).

8. The cooling fan module according to claim 4, wherein, an annular groove (38) is arranged radially outside the second cylindrical wall (24) and adjacent to the second cylindrical wall (24), and wherein a plurality of third ribs (40) extend substantially in the radial direction relative to the central axis (z) and are arranged in the annular groove (38), for further reducing or limiting the tangential component of the helical recirculation flow.

9. The cooling fan module according to claim 4, wherein, the outer ring (50) of the fan (18) comprises a cylindrical wall (50*a*) coaxial with the central axis (z), the flange (28) has a third cylindrical wall (52) coaxial with the central axis (z), the third cylindrical wall (52) and the cylindrical wall (50*a*) of the outer ring (50) have substantially the same radial distance relative to the central axis (z).

10. The cooling fan module according to claim 4, wherein, the outer ring (50) of the fan (18) comprises a cylindrical wall (50*a*) coaxial with the central axis (z), the flange (28) has a third cylindrical wall (52) coaxial with the central axis (z), a distance between the cylindrical wall (50*a*) of the outer ring (50) and the third cylindrical wall (52) in the direction of the central axis (z) is greater than or equal to 4 mm and smaller than or equal to 6 mm.

11. The cooling fan module according to claim 1, wherein, at least one of the frame (12) and the fan (18) is made of a material comprising polypropylene reinforced with glass fiber or polyamide reinforced with glass fiber.

12. A cooling fan module (10) for a vehicle, comprising:

a frame (12), comprising an edge (16) which defines an opening (14) of substantially circular shape through the frame (12), the opening (14) allowing a passage of air flow along a direction of a central axis (z) of the opening (14); and a fan (18) comprising a plurality of blades (20), the fan (18) being arranged to rotate about the central axis (z) to convey air flow through the opening (14);

wherein, the edge (16) comprises at least a first cylindrical wall (22) and a second cylindrical wall (24) that are coaxial with the central axis (z) of the opening (14), the second cylindrical wall (24) protrudes beyond the first cylindrical wall (22) in the direction of the central axis (z), the first cylindrical wall (22) is arranged at a first radial distance from the central axis (z), and the second cylindrical wall (24) is arranged at a second radial distance from the central axis (z), the second radial distance being greater than the first radial distance, the edge (16) further comprises an annular wall (23), wherein the first cylindrical wall (22) and the second cylindrical wall (24) are arranged on the annular wall (23) and extend in the direction of the central axis (z), the edge (16) further comprises a plurality of first ribs (30) that are arranged at intervals in a circumferential direction and located between the first cylindrical wall (22) and second cylindrical wall (24) in a radial direction relative to the central axis (z), for reducing or limiting a tangential component of a helical recirculation flow, the fan (18) further comprises an outer ring (50), radially outer ends of the blades (20) are connected by the outer ring (50), the edge (16) further comprises a flange (28) that extends in a radially internal direction from the first cylindrical wall (22) or the annular wall (23), and is spaced from the outer ring (50) in the direction of the central axis (z), the edge (16) further comprises a plurality of second ribs (32) for further reducing or limiting the tangential component of the helical recirculation flow, which are arranged at intervals on the flange (28) in the circumferential direction, and the second ribs (32) and the first ribs (30) are located at different positions in the direction of the central axis (z).

13. The cooling fan module according to claim 12, wherein, the first cylindrical wall (22) and the second cylindrical wall (24) are partially overlapped in the direction of the central axis (z).

14. The cooling fan module according to claim 12, wherein, the annular wall (23) substantially has the shape of a truncated cone, and extends inclined relative to the central axis (z), and wherein a first annular groove (26) is formed between the first cylindrical wall (22) and the annular wall (23).

15. The cooling fan module according to claim 12, wherein, the first ribs (30) and the second ribs (32) extend substantially in the radial direction relative to the central axis (z).

16. The cooling fan module according to claim 12, wherein, the second ribs (32) are radially aligned with the first ribs (30).

17. The cooling fan module according to claim 12, wherein, the outer ring (50) of the fan (18) comprises a cylindrical wall (50*a*) coaxial with the central axis (z), the flange (28) has a third cylindrical wall (52) coaxial with the central axis (z), the third cylindrical wall (52) and the cylindrical wall (50*a*) of the outer ring (50) have substantially the same radial distance relative to the central axis (z).

18. The cooling fan module according to claim 12, wherein, the outer ring (50) of the fan (18) comprises a cylindrical wall (50*a*) coaxial with the central axis (z), the flange (28) has a third cylindrical wall (52) coaxial with the central axis (z), a distance between the cylindrical wall (50*a*) of the outer ring (50) and the third cylindrical wall (52) in the direction of the central axis (z) is greater than or equal to 4 mm and smaller than or equal to 6 mm.

19. A cooling fan module (10) for a vehicle, comprising:

a frame (12), comprising an edge (16) which defines an opening (14) of substantially circular shape through the frame (12), the opening (14) allowing a passage of air flow along a direction of a central axis (z) of the opening (14); and a fan (18) comprising a plurality of blades (20), the fan (18) being arranged to rotate about the central axis (z) to convey air flow through the opening (14);

wherein, the edge (16) comprises at least a first cylindrical wall (22) and a second cylindrical wall (24) that are coaxial with the central axis (z) of the opening (14), the second cylindrical wall (24) protrudes beyond the first cylindrical wall (22) in the direction of the central axis (z), the first cylindrical wall (22) is arranged at a first radial distance from the central axis (z), and the second cylindrical wall (24) is arranged at a second radial distance from the central axis (z), the second radial distance being greater than the first radial distance, the edge (16) further comprises an annular wall (23), wherein the first cylindrical wall (22) and the second cylindrical wall (24) are arranged on the annular wall (23) and extend in the direction of the central axis (z), an annular groove (38) is arranged radially outside the second cylindrical wall (24) and adjacent to the second cylindrical wall (24), and wherein a plurality of first ribs (40) extend substantially in the radial direction relative to the central axis (z) and are arranged in the annular groove (38), for reducing or limiting the tangential component of the helical recirculation flow, the fan (18) further comprises an outer ring (50), radially outer ends of the blades (20) are connected by the outer ring (50), the edge (16) further comprises a flange (28) that extends in a radially internal direction from the first cylindrical wall (22) or the annular wall (23), and is spaced from the outer ring (50) in the direction of the central axis (z), the edge (16) further comprises a plurality of second ribs (32) for further reducing or limiting the tangential component of the helical recirculation flow, which are arranged at intervals on the flange (28) in a circumferential direction.

* * * * *